US006219008B1

(12) United States Patent
Ryou et al.

(10) Patent No.: US 6,219,008 B1
(45) Date of Patent: Apr. 17, 2001

(54) ANTENNA CONNECTOR FOR RADIO COMMUNICATION EQUIPMENT

(76) Inventors: Byunghoon Ryou, 643-5, Kozan-Dong, Ansan-si, Kyunggi-do, 425-020; Weonmo Sung, 560-14, Sotae-dong, Tong-ku, Kwangju, 501-220, both of (KR)

( * ) Notice: Subject to any disclaimer, the term of this patent is extended or adjusted under 35 U.S.C. 154(b) by 0 days.

(21) Appl. No.: 09/463,513

(22) PCT Filed: May 31, 1999

(86) PCT No.: PCT/KR99/00266

§ 371 Date: Jan. 27, 2000

§ 102(e) Date: Jan. 27, 2000

(87) PCT Pub. No.: WO99/63626

PCT Pub. Date: Dec. 9, 1999

(30) Foreign Application Priority Data

Jun. 1, 1998 (KR) ..... 98-9317 U
May 14, 1999 (KR) ..... 99-8208 U

(51) Int. Cl.[7] ..... H01Q 1/50

(52) U.S. Cl. ..... 343/906; 343/702; 343/895; 29/600

(58) Field of Search ..... 343/702, 749, 343/745, 752, 790, 791, 860, 895, 906; 29/600; H01Q 1/50

(56) References Cited

U.S. PATENT DOCUMENTS 4,772,895 * 9/1988 Garay et al. ..... 343/895
5,218,372 * 6/1993 Cheng ..... 343/895
5,274,393 * 12/1993 Scott ..... 343/906
5,742,259 * 4/1998 Annamaa ..... 343/906

* cited by examiner

*Primary Examiner*—Tho Phan
(74) *Attorney, Agent, or Firm*—McGuireWoods, LLP

(57) ABSTRACT

An antenna connector for radio communication equipment is disclosed. The above connector converts the conventional parallel resonance of an antenna into a series resonance by forming a flat cutout portion on its impedance transformer, or the signal feed part for the antenna, without changing the characteristics of the antenna, thus broadening the bandwidth of the antenna. The connector is also designed to control or broaden the bandwidth of the antenna in accordance with the structure of the impedance transformer. The connector of this invention easily and simply controls the bandwidth of an antenna by changing the size and height of the impedance transformer, by changing the surface area of the cutout portion of the impedance transformer, or by changing the number of turns of the antenna fitted over the impedance transformer. Therefore, the connector is effectively used at various frequencies, and effectively and quickly meets a variation of the central frequency of an antenna with the variation being caused by a change in environmental conditions of the antenna.

5 Claims, 4 Drawing Sheets

ANTENNA CONNECTOR FOR RADIO COMMUNICATION EQUIPMENT

TECHNICAL FIELD

The present invention relates, in general, to an antenna connector for radio communication equipment and, more particularly, to an antenna connector provided with an impedance transformer having a flat cutout portion, the connector being also designed to control the bandwidth of an antenna in accordance with the length of the antenna and the number of turns of the antenna, or a helical antenna, fitted over the impedance transformer and to allow the bandwidth of the antenna to be easily and simply controlled as desired.

BACKGROUND ART

As well known to those skilled in the art, the signal feed structure of conventional small-sized antennas for radio communication equipment has been designed in that a signal is directly fed to a coaxial line. Such a signal feed structure includes two types: a monopole type wherein a signal is fed to the plus portion of a coaxial line, and a dipole type wherein a signal is fed to both the plus and minus portions of a coaxial line.

However, the above-mentioned signal feed structure for antennas is problematic in that it results in an unbalance between signal feed lines of an antenna, thus practically making it difficult to match the impedance of the antenna. Such a signal feed structure also causes the contact portions between the antenna and the signal feed lines to be frequently changed, thus allowing the characteristics of the antenna to be undesirably changed. This results in a reduction in the antenna efficiency.

FIG. 4 shows the construction of a conventional wide-band helical antenna disclosed in U.S. Pat. No. 4,772,895. The above wide-band helical antenna is designed to broaden frequency response and comprises a feed port including a signal feed portion and a ground portion. The above antenna also comprises two helically configured conductive elements: first and second elements 200 and 400. The first element 200 has opposite ends, and exhibits a first pitch and a first electrical length. One end of the first element 200 is coupled to the signal feed portion of the feed port. On the other hand, the second element 400 has opposite ends, and exhibits a second pitch and a second electrical length. The second element 400 is coaxially wound around a portion of the first element. One end of the second element 400 is coupled to the ground portion of the feed port. The second pitch is equal to approximately one half of the first pitch, while the second electrical length is equal to approximately one third of the first electrical length. The above antenna further comprises a cylindrical spacer means 300. The above spacer means 300 is coaxially situated between the first and second elements 200 and 400, thus electrically insulating the two elements 200 and 400. The spacer means 300 is also sufficiently thin such that the first element is tightly coupled to the second element so as to broaden the frequency response exhibited by the first element.

In the above wide-band helical antenna, the spacer means, coaxially situated between the first and second helical elements positioned inside and outside of the antenna respectively, is used as a contact means for allowing the two elements to be coupled together. However, the above antenna is not designed to overcome the unbalance between the signal feed lines experienced in conventional antennas, thereby reducing the antenna efficiency. Another problem associated with the above wide-band helical antenna resides in that it is almost impossible to make a small-sized antenna.

DISCLOSURE OF THE INVENTION

Accordingly, the present invention has been made keeping in mind the above problems occurring in the prior art, and an object of the present invention is to provide an antenna connector for radio communication equipment, which converts the conventional parallel resonance of an antenna into a series resonance by forming a flat cutout portion on its impedance transformer, or the signal feed part for the antenna, without changing the characteristics of the antenna, thus broadening the bandwidth of the antenna, and which easily and simply controls the bandwidth of the antenna as desired by changing the size and height of the impedance transformer, by changing the surface area of the cutout portion of the impedance transformer, or by changing the number of turns of the antenna, or a helical antenna, fitted over the impedance transformer.

Another object of the present invention is to provide an antenna connector for radio communication equipment, which is effectively used at various frequencies, thus effectively and quickly meeting a variation of the central frequency of an antenna with the variation being caused by a change in environmental conditions of the antenna.

In order to accomplish the above objects, the present invention provides an antenna connector for radio communication equipment, comprising opposite ends, one end of the connector being brought into contact with an antenna and forming an impedance transformer part, and the other end engaging with the radio communication equipment, wherein the impedance transformer part comprises one or more impedance transformers, at least one of the impedance transformers being cut along a central axis thereof, thus having a flat cutout portion. In the above antenna connector, one or more flat cutout portions may be partially or totally formed on the impedance transformer. A longitudinal groove may be axially formed along a central axis on each flat cutout portion of the impedance transformer. In addition, two or more flat cutout portions may be formed on the impedance transformer along the central axis of the impedance transformer while being spaced out at regular intervals. The above impedance transformer may be separated from a locking boss of the connector, with a coiled conductive wire being positioned between the impedance transformer and the locking boss so as to electrically connect the impedance transformer to the locking boss. In the above antenna connector, two flat cutout portions may be formed on the impedance transformer in a way such that the two cutout portions are positioned at opposite sides of one middle wall.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
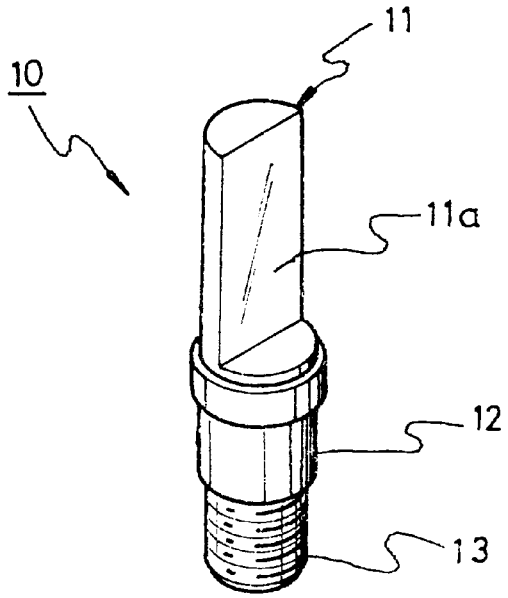
FIG. 1 is a perspective view of an antenna connector in accordance with the primary embodiment of the present invention.
Figure 2A:
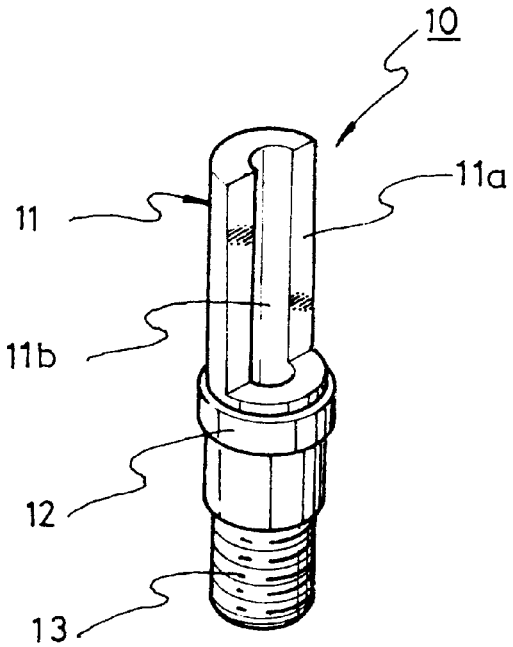
FIGS. 2*a* and 2*b* are perspective views of antenna connectors in accordance with the second and third embodiments of the present invention, respectively.
Figure 2B:
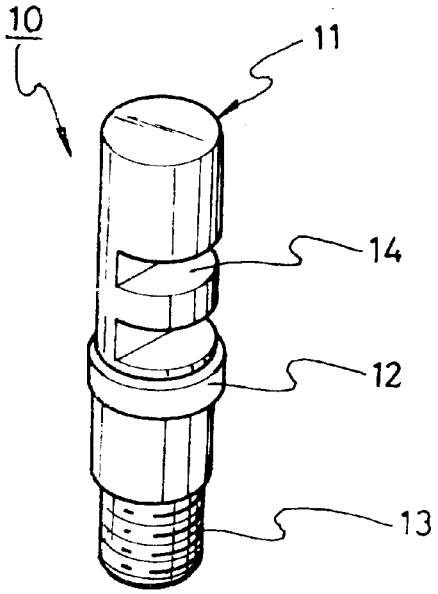

FIGS. 1, 2*a* and 2*b* are perspective views of antenna connectors in accordance with the primary to third embodiments of the present invention, respectively. As shown in FIG. 1, the antenna connector 10 according to the primary embodiment of this invention comprises a locking boss 12, which holds an antenna resonating at a center frequency of a transmit and receive frequency band. The connector 10 also has a connecting part 13 at which the connector 10 engages with the connector holder of radio communication equipment (not shown). The above connector 10 further comprises a cylindrical impedance transformer 11 or a signal feed part for the antenna. The above impedance transformer 11 is cut along its central axis, thus having a flat cutout portion 11*a*.

FIG. 2*a* shows an antenna connector 10 according to the second embodiment of this invention. In the antenna connector 10 of the second embodiment, a groove 11*b* is axially formed along the central axis on the flat cutout portion 11*a* of the impedance transformer 11 in a way such that the groove 11*b* communicates with and is aligned with a hole which is formed on both the locking boss 12 and the connecting part 13.

FIG. 2*b* shows an antenna connector 10 according to the third embodiment of this invention. In the antenna connector 10 of the third embodiment, two flat cutout portions 11*a* are formed on the cylindrical impedance transformer 11 while being spaced out at an interval. Each of the two cutout portions 11*a* is formed by a slit 14 having a semicircular cross-section.

The above antenna connector 10 of this invention has the following operational effect. That is, a helical antenna is fitted over the impedance transformer 11 and is grounded to the antenna, with the antenna being designed to resonate at a center frequency of a transmit and receive frequency band. In such a case, the conventional parallel resonance of the antenna is converted into a series resonance by the impedance transformer 11 or the signal feed part of the connector 10, thus broadening the bandwidth of the antenna at the practical center frequency.

In a detailed description, when the resonance circuit of an antenna exhibits a parallel resonance, the value Q, or the quality factor of either a loss reactance element or a resonance circuit, is substantially increased. This finally and substantially reduces the bandwidth of the antenna.

However, when the structure of the above antenna connector 10 is converted into a distributed integer circuit, thus allowing the input impedance, observed at a signal feed point, to exhibit a series resonance, it is possible to obtain a desired bandwidth at a wide frequency band.

Figure 4:
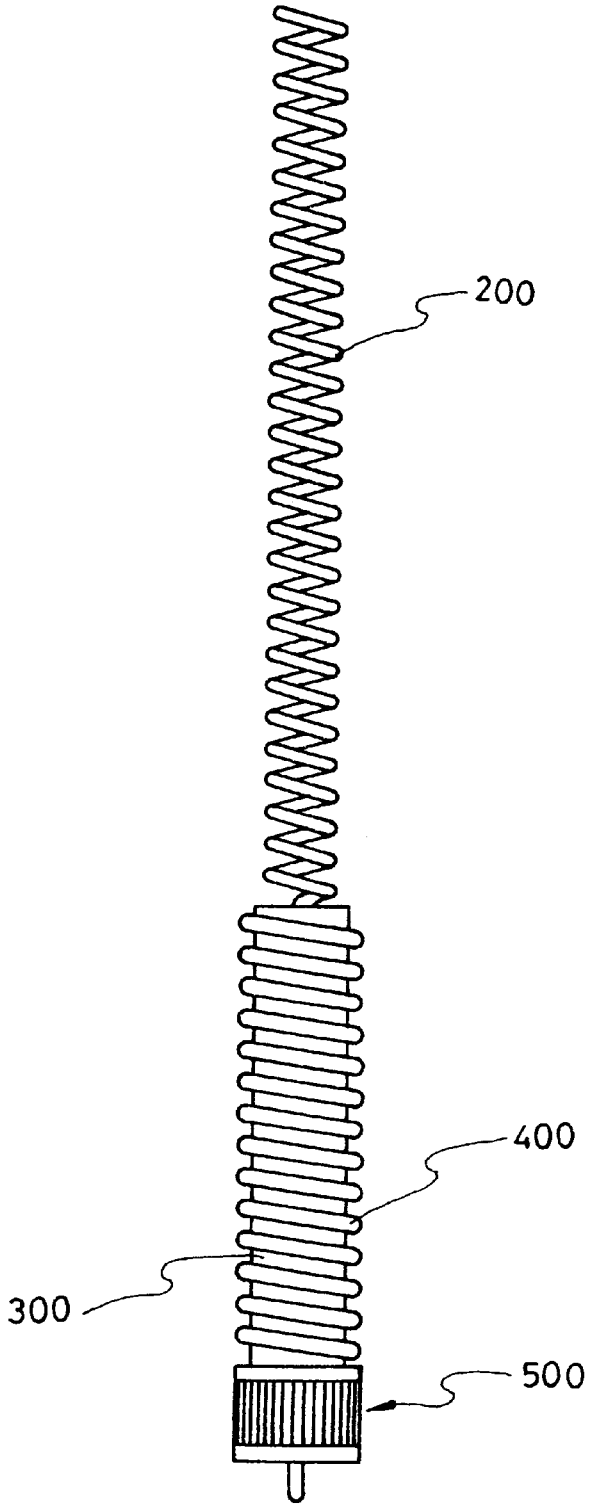
FIG. 4 PRIOR ART
FIG. 4 is a perspective view of a conventional wide-band helical antenna.
Figure 5A:
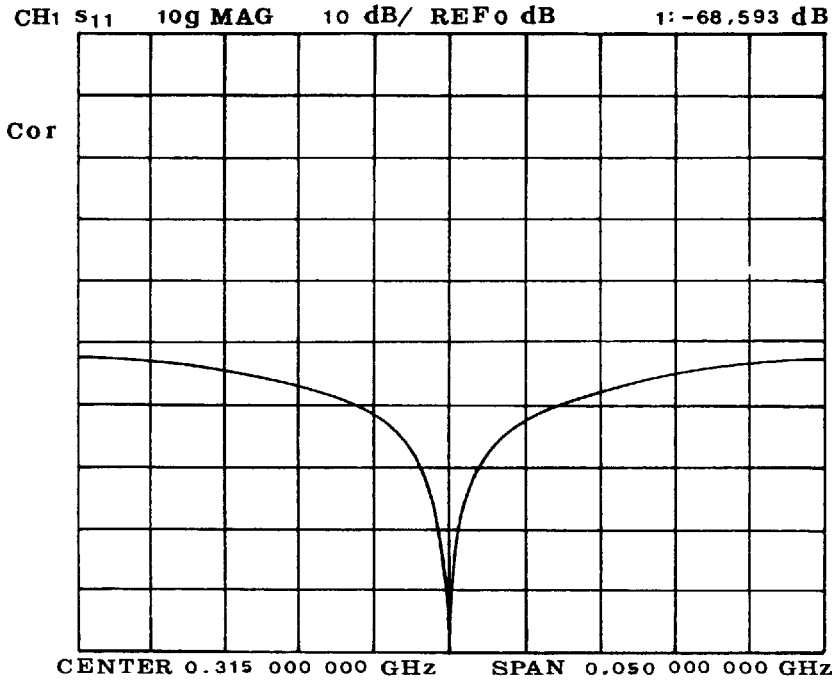
FIG. 5a PRIOR ART
FIG. 5*a* is a graph showing return loss as a function of frequency for the antenna of FIG. 4.

In an experiment performed to prove the operational effect of this invention, a normal mode helical antenna was used. FIG. 5*a* is a graph showing return loss as a function of frequency for the conventional wide-band helical antenna of FIG. 4. In the conventional helical antenna of FIG. 4, the signal feed structure uses an I-shaped engaging structure and uses a cylindrical contact part having a diameter of 3 mm and a height of 10 mm. In such a case, the antenna exhibits a bandwidth of about 8 MHZ at −20 dB return loss as shown in FIG. 5*a*.

Figure 3A:
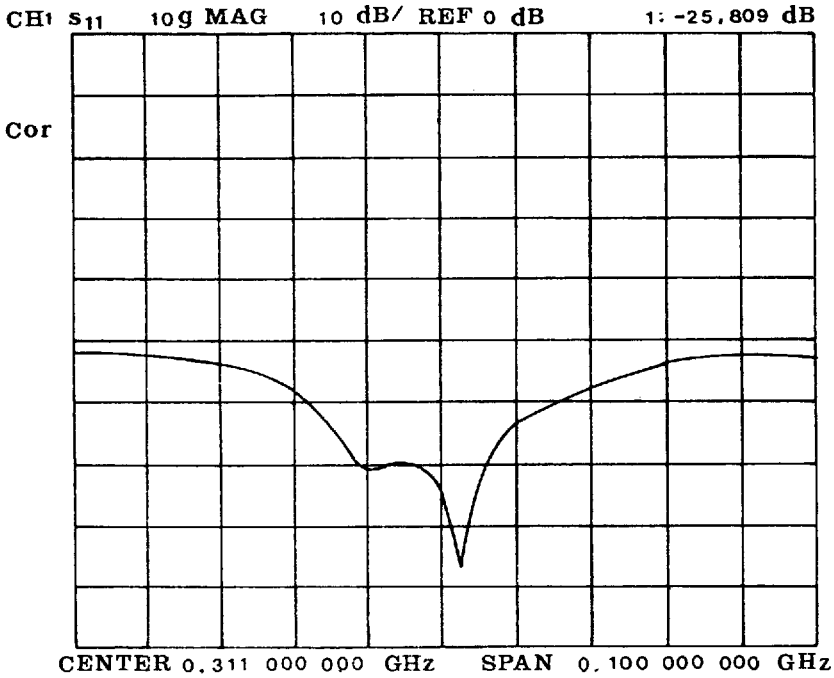
FIG. 3*a* is a graph, showing return loss as a function of frequency for an antenna used with a connector of this invention, with the center frequency of the antenna being 315 MHZ.

On the other hand, FIG. 3*a* is a graph, showing return loss as a function of frequency for an antenna used with the connector 10 of this invention, with the center frequency of the antenna being 315 MHZ. In the connector 10 of this invention, the impedance transformer is formed by cutting a cylindrical body, having a diameter of 3 mm and a height of 10 mm, along the central axis of the cylindrical body, thus having a flat cutout portion. The antenna, used with the connector 10 of this invention, exhibits a bandwidth of about 20 MHZ at −20 db return loss as shown in FIG. 3*a*.

As shown in FIGS. 3*a* and 5*a*, the antenna, used with the connector 10 of this invention and exhibiting a center frequency of 315 MHZ, has a bandwidth which is increased by about 250% relative to the center frequency. Such an increase in the bandwidth of an antenna may be expected in the case of a variety of linear antennas or microstrip antennas in addition to such helical antennas.

Figure 3B:
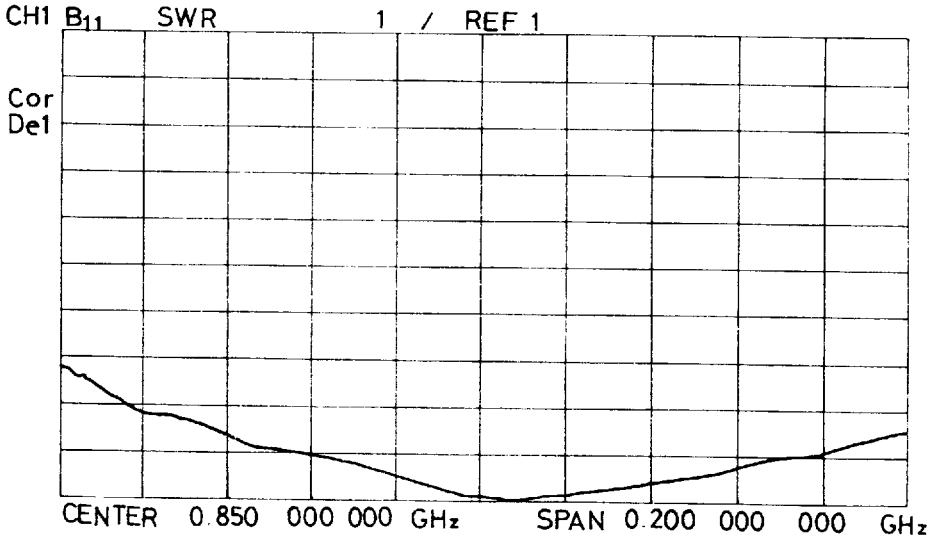
FIG. 3*b* is a graph showing both VSWR and impedance data as a function of frequency for an antenna used with a connector of this invention, with the center frequency of the antenna being 850 MHZ.
Figure 5B:
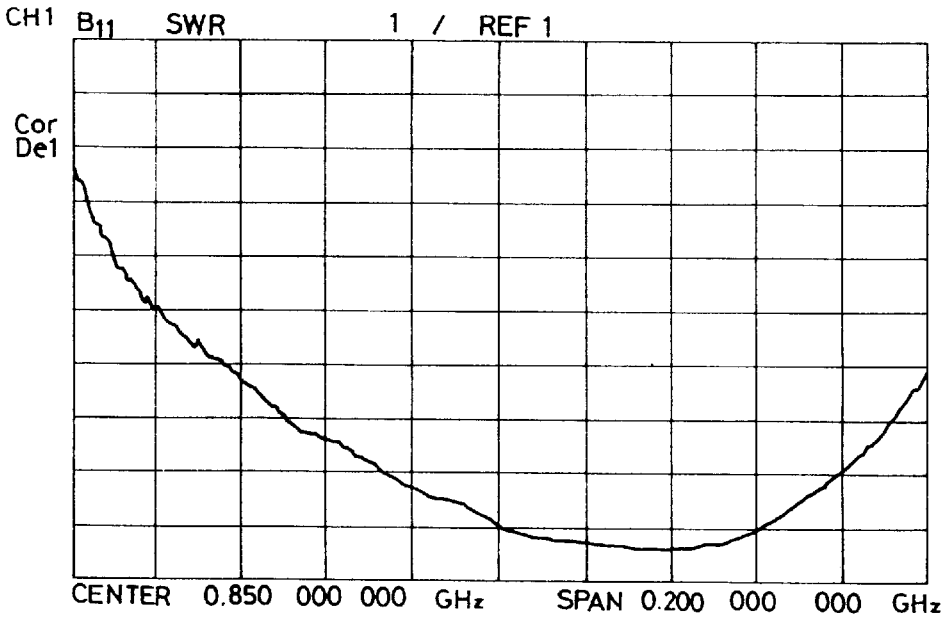
FIG. 5b PRIOR ART
FIG. 5*b* is a graph showing both VSWR and impedance data as a function of frequency of the antenna of FIG. 4.

FIG. 3*b* is a graph showing VSWR and impedance data as a function of frequency for an antenna used with a connector 10 of this invention, with the center frequency of the antenna being 850 MHZ. In such a case, the impedance transformer 11 of the connector 10 is formed by cutting a cylindrical body, having a diameter of 5 mm and a height of 2 mm, along the central axis of the cylindrical body, thus having a flat cutout portion 11*a*. As shown in the drawing, the frequency bandwidth of the antenna, used with the connector 10 of this invention, ranges from 750 MHZ to 950 MHZ, with a center frequency being 850 MHZ. When the graph of FIG. 3*b* is compared with the graph of FIG. 5*b*, it is obvious that the frequency bandwidth of the antenna, used with the connector 10 of this invention, is wider than that of the conventional helical antenna of FIG. 4.

In addition, the connector 10 of this invention is designed to control the bandwidth of an antenna by changing the dimensions of the impedance transformer 11 and/or the antenna as follows.

When the height of the impedance transformer is changed with both the length of the antenna and the diameter of the impedance transformer being not changed, the bandwidth of the antenna is reduced. In such a case, the antenna resonates at a low frequency.

On the other hand, when the diameter of the impedance transformer is enlarged with both the length of the antenna and the height of the impedance transformer being not changed, the bandwidth of the antenna is not changed. In such a case, the antenna resonates at a low frequency. Meanwhile, when the diameter of the impedance transformer is reduced with both the length of the antenna and the height of the impedance transformer being not changed, the bandwidth of the antenna is reduced with the antenna resonating at a low frequency.

In addition, the VSWR bandwidth of an antenna is changed in accordance with the surface area of the flat cutout portion 11*a* of the impedance transformer 11 of the connector 10. That is, when the cutout portion 11*a* of the impedance transformer 11 has a large area, the VSWR bandwidth of an antenna is reduced with the resonance frequency of the antenna being not changed. However, when the cutout portion 11*a* of the impedance transformer 11 has a small area, the VSWR bandwidth of an antenna is broadened. In such a case, the antenna resonates at a high frequency.

Both the resonance frequency and the bandwidth of an antenna may be controlled by changing the number of turns wound around the impedance transformer 11 of the connector 10, with both the diameter and the height of the impedance transformer 11 being not changed. That is, when the number of turns is reduced, the practical length of the antenna is reduced, and so the antenna resonates at a high frequency with the bandwidth of the antenna being reduced.

In the antenna connector 10 of FIG. 2*a,* a longitudinal groove 11*b,* which is not designed to convert the resonance characteristics of an antenna, is axially formed along the central axis on the flat cutout portion 11*a* of the impedance transformer 11. An antenna, which is designed to resonate at a center frequency of a transmit and receive frequency band, is brought into contact with the external surface of the above impedance transformer 11. In such a case, the bandwidth of the antenna is controlled by changing the resonance characteristics of the antenna. In such a case, the resonance characteristics of the antenna are changed in accordance with the structure of the connector 10 which feeds a signal to the antenna through the impedance transformer 11.

On the other hand, in the antenna connector 10 of FIG. 2*b,* two or more slits 14 are formed on the cylindrical impedance transformer 11 while being spaced out at regular intervals. The above connector 10 allows the antenna to exhibit a desired bandwidth since the connector 10 is brought into contact with the antenna at the impedance transformer 11 or the signal feed part for the antenna.

In the present invention, the connector 10 may be integrated with the impedance transformer 11 as described above. Alternatively, the connector 10 of this invention may have a separate impedance transformer 11 which is electrically separated from the locking boss 12 of the connector 10. In such a case, the separate impedance transformer 11 is installed at the central axis of an antenna, with a coiled conductive wire being positioned between the impedance transformer 11 and the locking boss 12 of the connector 10 so as to electrically connect the impedance transformer 11 to the locking boss 12. As a further alternative, two cutout portions may be formed on the impedance transformer 11 in a way such that the two cutout portions are positioned at opposite sides of one middle wall.

In a brief description, when the shape and size of the impedance transformer 11 of the connector 10 according to this invention is changed, it is possible to convert the conventional parallel resonance of the resonance circuit of an antenna into a series resonance. The connector 10 of this invention thus allows the antenna, typically designed to parallely resonate at a center frequency, to exhibit a bandwidth which is broadened by two or three times that of a conventionally expected bandwidth. The connector 10 of this invention also allows the bandwidth of an antenna to be somewhat freely controlled as desired.

INDUSTRIAL APPLICABILITY

As described above, the present invention provides an antenna connector for radio communication equipment. The connector of this invention converts the conventional parallel resonance of an antenna into a series resonance by forming a flat cutout portion on its impedance transformer, or the signal feed part for the antenna, without changing the characteristics of the antenna, thus broadening the bandwidth of the antenna. The above connector is designed to control or broaden the bandwidth of an antenna in accordance with the structure of its impedance transformer regardless of the types of antennas.

The connector of this invention also easily and simply controls the bandwidth of an antenna by changing the size and height of the impedance transformer, by changing the surface area of the cutout portion of the impedance transformer, or by changing the number of turns of the antenna, or a helical antenna, fitted over the impedance transformer. Therefore, the connector of this invention is effectively used at various frequencies, and so the connector effectively and quickly meets a variation of the central frequency of an antenna with the variation being caused by a change in environmental conditions of the antenna.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. An antenna connector for radio communication equipment, comprising opposite ends, one end of said connector being brought into contact with an antenna and forming an impedance transformer part, and the other end engaging with the radio communication equipment, wherein said impedance transformer part comprises one or more impedance transformers, at least one of the impedance transformers being cut along a central axis thereof, thus having a flat cutout portion.

2. The antenna connector according to claim 1, wherein one or more flat cutout portions are partially or totally formed on said impedance transformer.

3. The antenna connector according to claim 2, wherein a groove is axially formed along a central axis on each flat cutout portion of the impedance transformer.

4. The antenna connector according to claim 1, wherein two or more flat cutout portions are formed on the impedance transformer along the central axis of said impedance transformer while being spaced out at regular intervals.

5. The antenna connector according to claim 1, wherein two flat cutout portions are formed on the impedance transformer in a way such that the two cutout portions are positioned at opposite sides of one middle wall.

* * * * *